US007503138B2

(12) United States Patent
Tal et al.

(10) Patent No.: US 7,503,138 B2
(45) Date of Patent: Mar. 17, 2009

(54) MAGAZINE ALIGNER FOR PISTOL MAGAZINE LOADERS

(76) Inventors: Guy Tal, P.O. Box 302, Rosh Ha'ayin (IL) 48103; Ran Tal, P.O. Box 302, Rosh Ha'ayin (IL) 48103

( * ) Notice: Subject to any disclaimer, the term of this patent is extended or adjusted under 35 U.S.C. 154(b) by 169 days.

(21) Appl. No.: 11/598,348

(22) Filed: Nov. 13, 2006

(65) Prior Publication Data

US 2007/0107291 A1 May 17, 2007

Related U.S. Application Data

(60) Provisional application No. 60/736,005, filed on Nov. 14, 2005.

(51) Int. Cl.
*F41A 9/83* (2006.01)

(52) U.S. Cl. ..... 42/87; 42/50; 89/33.1

(58) Field of Classification Search ..... 42/18, 42/22, 49.02, 50, 87, 98, 106; 89/197, 33.1
See application file for complete search history.

(56) References Cited

U.S. PATENT DOCUMENTS 3,019,542 A * 2/1962 Manthos ..... 42/18
3,252,237 A * 5/1966 Korzeniewski ..... 42/75.02
3,906,652 A * 9/1975 Evans ..... 42/50
4,570,371 A * 2/1986 Mears ..... 42/90
4,706,402 A * 11/1987 Csongor ..... 42/87
4,719,715 A * 1/1988 Howard ..... 42/87
4,799,323 A * 1/1989 Musgrave ..... 42/90
4,993,180 A 2/1991 Upchurch
5,249,386 A 10/1993 Switzer
5,377,436 A 1/1995 Switzer
5,402,594 A * 4/1995 Switzer ..... 42/90
5,417,003 A * 5/1995 Claveau ..... 42/90
D477,047 S 7/2003 Springer
6,817,134 B2 * 11/2004 Newman ..... 42/87
7,257,919 B1 * 8/2007 Farley ..... 42/87
2004/0020096 A1 * 2/2004 Tal et al. ..... 42/87
2004/0159036 A1 * 8/2004 Newman ..... 42/87

FOREIGN PATENT DOCUMENTS

WO PCT/IL2006/000477 10/2006

* cited by examiner

*Primary Examiner*—Bret Hayes
(74) *Attorney, Agent, or Firm*—David Pressman

(57) ABSTRACT

A magazine aligner is positioned inside a pistol magazine loader for centering the open side of magazines of different widths and depths when mounted into the loader to be in line with a round-inserting plunger of the loader. The aligner comprises an inverted "V"-shaped element adapted to accept the open side of magazines from below and includes a spring for keeping tension on the magazine.

20 Claims, 3 Drawing Sheets

MAGAZINE ALIGNER FOR PISTOL MAGAZINE LOADERS

CROSS-REFERENCE TO RELATED APPLICATIONS

This application claims the benefit of our U.S. Provisional Patent Application Ser. No. 60/736,005, filed Nov. 14, 2005, and our PCT patent application Ser. No. PCT/IL2006/000477, filed Apr. 20, 2006.

BACKGROUND

1. Field

The present application relates to firearm magazine loaders, particularly to an aligner for aligning magazines in such a loader.

2. Prior Art

Many small firearms, including pistols, assault rifles, and submachine guns, utilize and fire rounds (also known as cartridges and ammunition). Each round is substantially elongated and comprises a deep cuplike case (also known as a shell casing and sometimes also a cartridge), usually of brass, which is filled with an explosive propellant. At its rear or closed end, the case has a rim or flange containing a primer; the front and opposite end of the case is open. A bullet, slug, or head, usually of lead (optionally jacketed) is partially inserted into the open or front end of the case by crimping the case onto the bullet.

The rounds are held within and fed into the firearm from a magazine, also known as a clip. A detachable magazine has become dominant throughout the world. The term 'magazine' is broad, encompassing several geometric variations, including curved magazines. Most detachable magazines are similar, varying in form and structure, rather than in their general principles of operation.

Magazines usually take the form of an elongated container having a generally rectangular cross-section, which is attached to the underside of the firearm. Magazines are commonly made of aluminum alloys, plastic, steel, or a combination. They are usually closed on five sides and open on a sixth, upwardly facing, top, side, or end, and are substantially hollow. The top or open side has a rectangular opening and includes two round-retaining members, known as feed lips, that project into the opening. Magazines have an internal spring which urges a follower or pusher (a shaped piece of plastic or metal) toward the open side. The follower in turn urges the rounds as a group up against the lips. The lips act as a stop for the rounds so that they are not expelled from the magazine.

Rounds are stacked or oriented in the magazine such that the longitudinal axes of the rounds are substantially parallel and perpendicular to the direction of travel of the spring and follower. Adjoining rounds are oriented side-by-side, i.e., the bullets of adjacent rounds are next to each other, as are the cases.

The rounds are usually stacked in the magazine, either in a single straight column or in a staggered (zigzag) column (also called double-stacked or high-capacity) fashion. The latter magazines, being wider, achieve higher round capacity compared to single-column magazines of the same overall length.

Commonly, in pistol magazines and in some submachine gun magazines, whether staggered or not, the space between the retaining lips is smaller than the case diameter of the rounds so that the two lips of the magazine hold the topmost round. Magazines of most assault rifles and submachine guns contain staggered rounds, and in contrast to the above pistol magazines, the topmost round is held in place by only a single lip. The latter magazines are not relevant here, so hereafter the term 'magazine' will mean magazines where two lips retain the topmost round.

Prior to use, a firearm magazine must be loaded, charged, or filled with rounds. When a magazine is being loaded, it is necessary to depress all previously loaded rounds to provide vacant space below the lips so an additional round can be inserted or loaded into this space. Each time another round is loaded the spring is further compressed, requiring more insertion force. When a magazine is fully loaded, the spring is fully compressed and exerts maximum upward force against the follower and rounds towards the lips.

Loading magazines is relatively time-consuming, tedious, and painful practice if done with bare fingers. Pain accumulates and intensifies as more rounds are loaded against the increasing spring pressure, thus slowing the loading process. When a plurality of magazines are to be loaded, much time is required, shortening reposing, training, or combat time. In combat circumstances, slow reloading can be life-threatening.

To increase loading speed and decrease finger pain, numerous magazine loaders have been designed. However, in the market there are many different pistol magazines. They differ in their round capacity, length, width, depth, round caliber, materials, adaptability to match magazine wells, shape of lips, and magazine locking or latching mechanism. Often, each pistol has its own unique magazine. Therefore, to accommodate the extremely wide range of magazines with all their mechanical variations, manufacturers of magazine loaders had to manufacture the following loader types:

1. loaders of different fixed sizes, basically described in U.S. Pat. No. 4,993,180 to Upchurch Feb. 19, 1991. Such is a family of three different size loaders from ADCO Sales Inc., shown at www.adcosales.com, and sold under the trademark Super Thumb models ST1, ST2 and ST3. Many other similar loaders from Glock Inc., SIG Arms, Springfield Armory and others exist comprising a hollow body with a fixed projecting member or plunger for inserting, pushing, or forcing rounds into a magazine;
2. loaders with an integral user-adjustable mechanism to fit the loader to a particular magazine, such as loaders (U.S. Pat. Nos. 5,249,386 and 5,377,436 to Switzer, Oct. 5, 1993 and Jan. 3, 1995, respectively) sold under the trademark HKS. These have different overall sizes and a magazine length adjuster or fitter in each (HKS has ten different magazine loaders in the market for covering most of the magazines available); or
3. loaders with inserts or spacers to accomodate different magazine widths, such as the loader model #104 shown at www.worldwideordnance.com and sold under the trademark Cambi (U.S. Pat. No. 6,817,134 to Newman Nov. 16, 2004) having four separate insertable spacers.

In summary, while there have been attempts to provide a mechanism for accepting a large range of different pistol magazines in a single magazine loader, none was able to do just that, and all are quite limited in the range of magazines they accept. Further, all existing 'adjustable' loaders have to be adjusted prior to use, and none has an automatic adjusting means.

ADVANTAGES

Accordingly, one advantage of one or more aspects is to provide (a) a method and mechanism for allowing a wide range of different magazines to be loaded with a single magazine loader. Other advantages of various aspects are to provide (b) a durable mechanism that is automatically adjusted without user intervention prior or during loading, (c) a low-cost, small-size, lightweight mechanism comprising few parts, and (d) a mechanism that can be utilized in different types of prior-art magazine loaders and in future ones.

Still further advantages of various aspects will become apparent from a consideration of the drawings and ensuing description.

SUMMARY

According to one aspect, a method and mechanism are provided for aligning magazines of different dimensions inside a magazine loader. This enables one loader to load rounds inside a range of magazines. This mechanism comprises an inverted "V"-shaped body (hereafter "aligner") hingely coupled to the body of the loader and adapted to accept the open end of the magazine as it is inserted into the loader from below. The aligner guides and aligns the magazine to the center line of the loader where a round's plunger is positioned, thereby enabling the plunger to force down the topmost round in the magazine. A spring member is fitted between the body of the loader and the aligner to keep the aligner in constant tension or pressure over the magazine. Thus, magazines of different widths and depths can be loaded without user intervention prior or during loading. Also, the length of the magazine and its Doorplate has no effect on the operation of the aligner and can be of any size.

DRAWING FIGURES

FIG. 1B is a front view, FIG. 1C is a top view, and FIG. 1D is a side view.

DRAWING REFERENCE NUMERALS

Figure 1A:
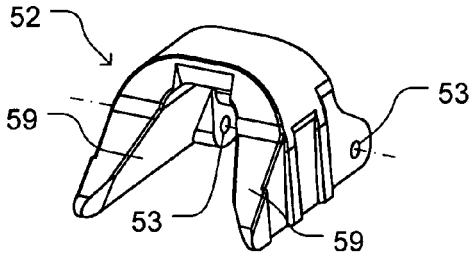
FIG. 1A is a perspective view of an aligning mechanism or 'aligner'.

10 double-stack magazine
12 round
13 new round
14 lip of double-stack magazine
20 plunger
30 loader
32 body of loader
37 arm of loader
38 bridge
40 press
52 aligner
53 aligner hole
54 aligner hinge
56 aligner pin
58 aligner spring
59 aligner wing
60 hand
90 center line
100 single stack magazine
114 lips of single stack magazine
320 first alternative body
380 alternative bridge
520 first alternative aligner
580 alternative aligner spring
585 alternative aligner spring
590 alternative aligner wings
595 second alternative aligner
20A alternative plunger
52A third alternative aligner
53A hole of alternative aligner
59A wing of alternative aligner

DETAILED DESCRIPTION—Preferred Embodiment—FIGS. 1A to 3A

Figure 1B:
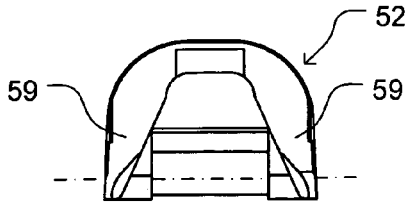
FIG. 1B to 1D are representations of the aligner, where
Figure 1E:
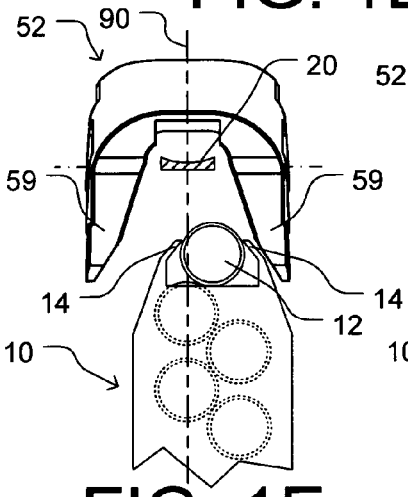
FIG. 1E is a front view of the aligner accepting an off-centered double-stack magazine.
Figure 2A:
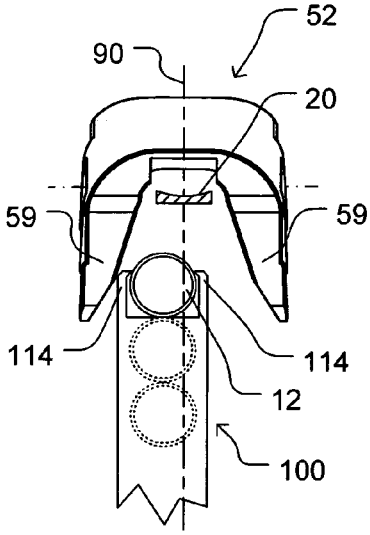
FIG. 2A is a front view of the aligner accepting an off-centered single-stack magazine.
Figure 2B:
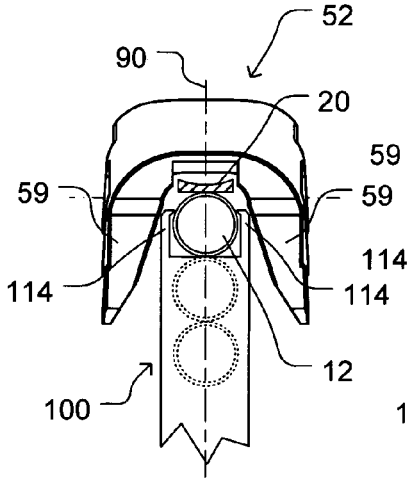
FIG. 2B is a front view of the aligner centering the single-stack magazine.
Figure 2C:
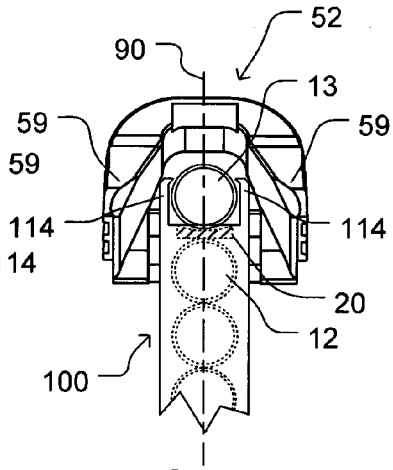
FIG. 2C is a front view of the aligner with the single-stack magazine at a loading position.
Figure 2D:
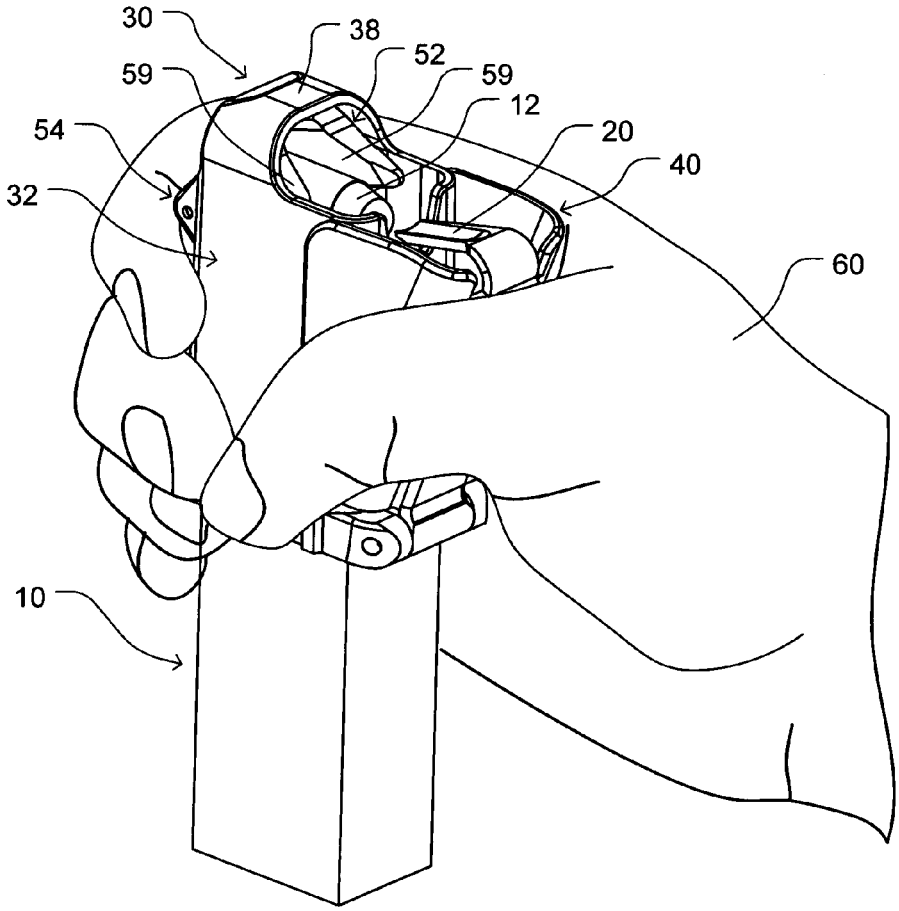
FIG. 2D is a perspective view of a loader coupled to a magazine and held by hand.
Figure 3A:
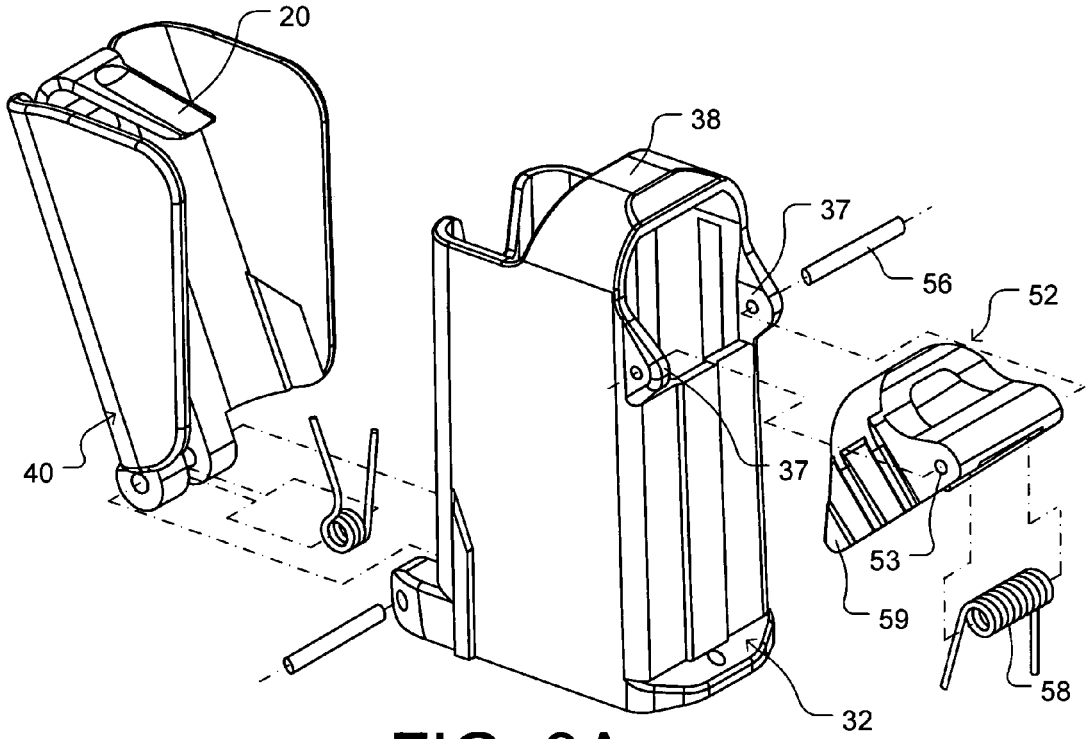
FIG. 3A is a rear exploded view of the loader.

FIG. 1A is a perspective view of a preferred embodiment of an aligner 52 for aligning magazines within a magazine loader (30 in FIG. 2D). The aligner is preferably shaped as an inverted "V" i.e., comprises two inclined-apart spaced wings 59 coupled together at their top. The upper joined parts of the wings are closer than their bottom ends. The wings are symmetrical, having inner inclined faces or surfaces that are flat and smooth, and can be either parallel or slightly converging at their ream. At the rear of each wing is a through hole 53 for an aligner pin 56 (FIG. 3A). When the aligner is seen in its inverted V-shaped configuration (FIGS. 1B and 1E), the wings preferably taper from wide at their tops where they are coupled together to narrow and somewhat sharp at their bottoms.

A front view of aligner 52 is shown in FIG. 1B. The inverted V-shaped opening between wings 59 is clearly shown.

Figure 1D:
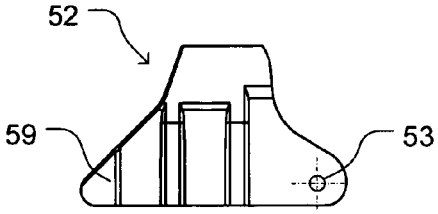
Figure 1C:
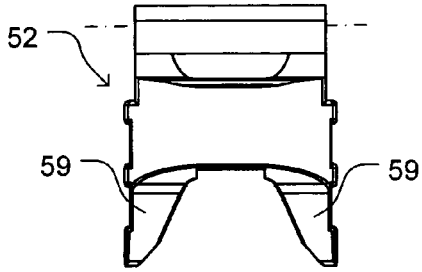

FIG. 1C is a top view of the aligner and FIG. 1D is a side view of the aligner with through hole 53 seen at the lower right of the wing. Note that when seen from the side, each wing is narrow at its top and flares out at its bottom.

FIG. 1E is a front view of the aligner angled down, around pin 56 (FIG. 3A) inserted through the through holes in the rear of the wings. The aligner is shown in an initial position inside a loader's body (30 in FIG. 2D) so as to enable the aligner to accept a magazine between its spaced wings 59. In this example, the magazine is a double-stack magazine 10 shown before loading a new round and off-center to the right of a center vertical line 90. Only one wing of the aligner touches the magazine in this example. Magazine 10 has lips 14 holding between them a topmost round 12. The magazine also contains few rounds (not numbered) below round 12. A sectional view of the loader's projecting member or plunger 20 (shown complete in FIG. 2D) is shown centered between the wings of the aligner and spaced generally above topmost round 12. The role of the loader's plunger is to force, insert, or push the topmost round in the magazine further inside the magazine to provide a vacant space below the lips of the magazine so that a new round can be loaded in the vacant space.

Figure 1F:
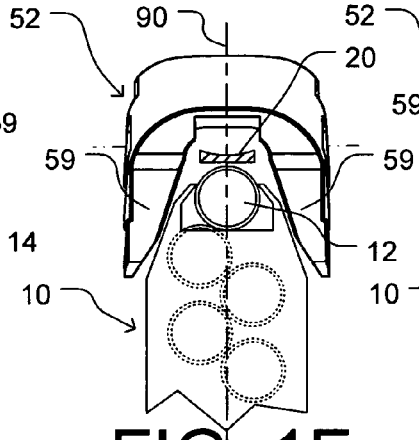
FIG. 1F is a front view of the aligner centering the double-stack magazine.

FIG. 1F is a front view of the aligner still angled down with the open top side of the magazine now centered in the aligner. Hence, the magazine will also be centered in the body of the loader (not shown) and in line with respect to the plunger, along center line 90. Plunger 20 is directly above and close to topmost round 12, or it may contact or rest on the topmost round.

Figure 1G:
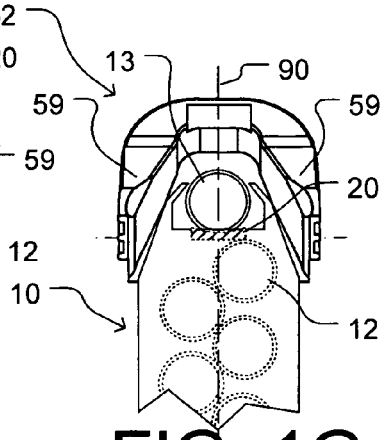
FIG. 1G is a front view of the aligner with the double-stack magazine at a loading position.

FIG. 1G is a front view of the aligner angled up with the magazine pushed into it from below. The magazine is centered in the aligner and body and with respect to plunger 20. The plunger forces round 12, and all other rounds, further inside the magazine. A new round 13 is shown loaded above the plunger.

Figure 1H:
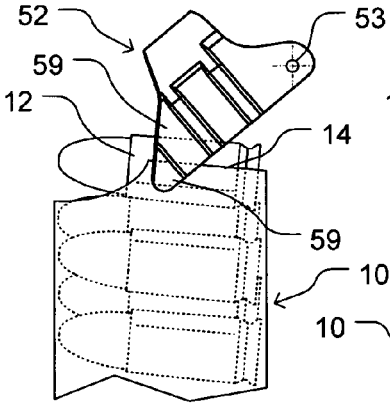
FIG. 1H is a side view of the aligner of FIG. 1E.

FIG. 1H is a side view of the aligner and magazine as positioned in FIG. 1E, less the plunger. The aligner is angled down and the magazine positioned partially between the aligner's wings. The wings of the aligner engage the magazine approximately half way across the magazine's horizontal depth.

Figure 1I:
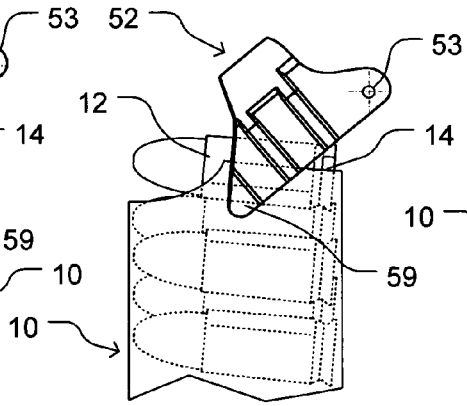
FIG. 1I is a side view of the aligner of FIG. IF.
Figure 1J:
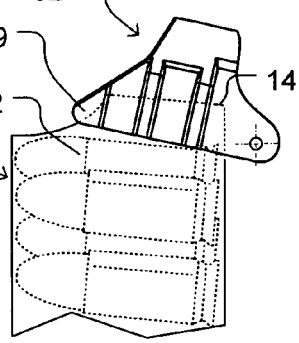
FIG. 1J is a side view of the aligner of FIG. 1G.

FIG. 1I is a side view of the aligner as shown in FIG. 1F, less the plunger, and FIG. 1J is a side view of the aligner as shown in FIG. 1G, less the plunger and round 13. The aligner is shown angled up in FIG. 1J.

FIGS. 2A to 2C are similar to FIGS. 1E to 1G, but with a single-stack magazine 100 having lips 114. The magazine is initially left of center line 90 in FIG. 2A.

A perspective view of a pistol magazine loader 30 with the aligner is shown in FIG. 2D. The loader is sold under the trademark "UpLULA" and is shown and described in our international patent application number PCT/IL2006/000477, U.S. Ser. No. 11/886,144, filed Sep. 12, 2007. Plunger 20 (partly shown in FIGS. 1E to 1G and in FIGS. 2A to 2C) is shown at an "away" position in the loader's press 40 held in a user's hand 60. The loader has a substantially hollow body 32 with an open bottom end which is inserted over or onto the top open side of magazine 10 and held substantially upright in an operating position. The bottom of the magazine is supported by a table or the like (not shown). The magazine is shown pushing aligner 52 up from below so that its wings 59 are visible and angled up. The magazine contains a topmost round 12. The body of the loader has a bridge 38 across two of its sides.

FIG. 3A is a rear exploded view of loader 30 of FIG. 2D. Only the aligner section is discussed. Magazine aligner 52 is coupled to the body of the loader by a rear hinge 54 (FIG. 2D) comprising aligner pin 56, body arms 37, and side holes 53 at the rear of aligner 52. Pin 56 is fixed through holes (not numbered) in arms 37 of the main body of the loader and through side holes 53 of the aligner. Side holes 53 thus provide a coupler or attachment means for attaching the aligner to the loader. An aligner helical torsion spring 58 is positioned at the rear of the aligner and is retained by pin 56 extending through the coil of the spring, as well as holes 53 of the aligner and the holes (not numbered) in arms 37 of the main body. The two arms of spring 58 are positioned so that one presses against the rear of the aligner and one presses against the external rear wall of the body to exert force to angle the aligner down inside the body, as shown in FIG. 1H. Two projection lines show how all the parts assemble together.

Operation—Preferred Embodiment—FIGS. 1A to 3A

Our magazine loader provides substantial assistance to firearm users by enabling them to more safely, comfortably, and rapidly load pistol magazines without finger pain or injury.

Since pistol magazines come in varying dimensions and calibers, magazine aligner 52 enables a single pistol magazine loader to fit many magazines and round calibers. The aligner centers the open side of the magazine by its width in the loader rather than by its bottom or base of the magazine. This causes the loader's plunger to be centered above the topmost round in the magazine. If not centered, or without an aligner, a thin magazine may wiggle freely in the loader so that plunger 20 (FIG. 2A) may miss the topmost round and engage a lip of the magazine, or miss the magazine altogether. The length of the magazine is generally not important to the operation of the aligner; only the width and depth of the magazine are relevant. Using the aligning mechanism, the loader automatically adapts to fit both single and double-stack magazine widths, and with a wide size range of rounds, preferably from .380 up to .45 caliber, making the loader a more widely usable pistol magazine loader.

In addition to its usability in pistol magazine loader 30 of FIG. 2D, aligner 52 may be used in many other existing or future loaders. E.g., the aligner may be used, with or without modifications, with loaders having a plunger for pushing down rounds, such as those sold under the trademarks HKS, Cambi, ADCO, Glock, H&K, SIG, Wilson Combat, and others. The aligner is preferably made of plastic, but can also be made of metal or a combination.

The aligner operates as follows. At its initial position, the aligner is in the loader and preferably is angled approximately 45 degrees down, as best shown in FIG. 1H. It is pre-pressured at its rear (not shown) by an arm of spring 58 (FIG. 3A). When loading a magazine, the user usually mounts the loader on, say, a preloaded double-stack magazine 10 which is, say, off-centered as shown in FIG. 1E. The off-centered open side of the magazine reaches the inner smooth surface of, say, right wing 59 of the aligner as shown.

The user then forces the loader down further on the magazine, thereby causing the magazine to slide up against the inwardly-inclined internal surface of the right wing until the opposite top side of the magazine reaches the other wing of the aligner, as shown in FIG. 1F. I.e., the aligner has forced the magazine from an off-center position to a centered position. The magazine is now width-centered in the aligner and thus the loader, along center line 90. The force of spring 58 is sufficient to keep the aligner down as the magazine slides up along the aligner wing.

As the loader is pushed further down by the user, the spring-loaded aligner will start to angle up by the force of the magazine from below while keeping the magazine centered until plunger 20 engages the case of topmost round 12, as shown in FIG. 1G. The aligner keeps the open side of the magazine centered all along the downward distance of the loader as it is forced further down while the plunger forces down the topmost round further into the magazine to create a vacant space below the lips of the magazine.

The aligner is designed and arranged to align and center the magazine, preferably before the topmost round in the magazine reaches the plunger. Once a new round is loaded in the vacant space, raising the loader back up to start a new loading cycle causes the aligner to angle back down by force of spring 58 to its initial rest position as shown in FIGS. 1E and 1H.

Thus, the aligner is tilted all the way up for every round-loading cycle in the magazine. The same aligning action is achieved with thinner single-stack magazines as shown in FIGS. 2A to 2C. Since the aligner is hinged at its rear above the magazine, it is angled up by the magazine from below. The resistance of the inner surface of the two wings of the aligner on the side walls of the magazine causes the magazine to also move forward toward the front wall of the body and toward the plunger of the loader. This aids magazines of shorter depth to be loaded as well, as they are brought closer to the plunger in this loader example. While the magazine is centered at its upper open side by the aligner in the loader, the magazine may be off-centered at its bottom without interfering much with the loading process.

Hence, the aligner allows magazines of a variety of different widths, depths, and calibers to be centered and loaded in a single magazine loader, eliminating the need to manufacture spacers or loaders of various dimensions to match the variety of magazines available.

Figure 3B:
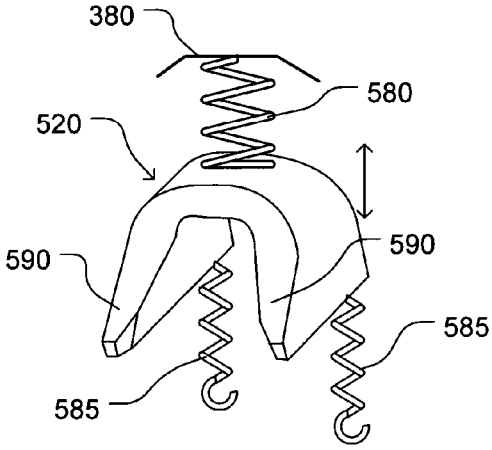
FIG. 3B is a simplified perspective view of a first alternative aligner.

Description—First Alternative Embodiment—FIG. 3B

FIG. 3B is a simplified perspective view of a first alternative aligner 520 having two wings 590 with the same basic construction as aligner 52 of FIG. 1. Aligner 520 is positioned below a bridge 380 (or 38) of the loader and is constructed to move in a straight line up and down in the main body on rails, sliders, or limiters (not shown), having no hinge. In one instance, a compression spring 580 is positioned between aligner 520 and bridge 380. Spring 580 has the same function as aligner spring 58 previously described. In another variation, aligner 520 may have one or more extension springs 585 connected to its bottom on one side and to the main body of the loader on the other side for exerting a downwards force on the aligner in a manner similar to the described above. The round's plunger is not shown.

Operation—First Alternative Embodiment—FIG. 3B

Aligner 520 is built and works much the same as aligner 52 but is movable in a linear path up and down as shown by the double-headed arrow. Compression spring 580 keeps the aligner pressured on the magazine so that the magazine aligns itself centrally between wings 590. Aligner 520 will move up when aligning a magazine and back down when the loader is lifted up. The same operation applies when using spring 585 instead of spring 580, or if other pressure mechanism forces the aligner down to keep pressure on the magazine.

Figure 3C:
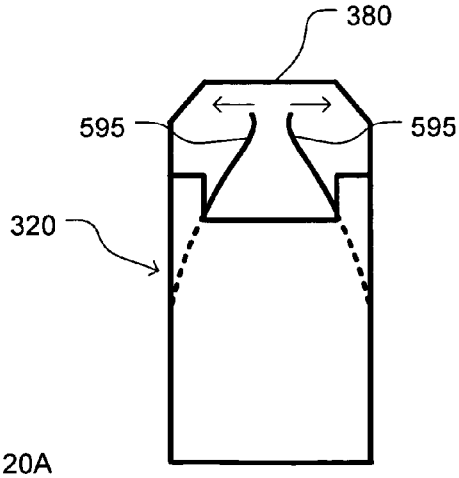
FIG. 3C is a simplified front view of a second alternative aligner.

Description—Second Alternative Embodiment—FIG. 3C

FIG. 3C is a simplified front view of a second alternative aligner 595 having two independent wings working independently of each other. Aligner 595 is constructed internally and symmetrically between two opposite sidewalls of an alternative loader body 320, or any other loader body, below bridge 380 (or 38) or another. Aligner 595 is a minimal aligner and comprises two smooth flat leaf spring members or wings (here shown only the side view), preferably made of plastic or metal, attached to the lower internal part of the body. The wings extend and come closer symmetrically upwards within the loader. Alternatively, aligner 595 may be attached oppositely below the bridge and extend symmetrically downwards (not shown) for doing the same.

Small turning wheels (not shown) may be attached to the distal ends of the springy wings to eliminate friction between the internal surface of the wings and the magazine. Alternatively, the springy wings 595 may be coated with low-friction material, such as PTFE, to reduce friction. The round plunger is not shown.

Operation—Second Alternative Embodiment—FIG. 3C

Aligner 595 has a similar aligning function as aligner 52 of FIGS. 1. Springy wings 595 force an off-center magazine inserted in the loader from below to be centered at its lop inside the body. Each wing will move outwardly, in the direction of the arrow, until the pressure on both wings is equal, thereby aligning the magazine center in the body.

Figure 3D:
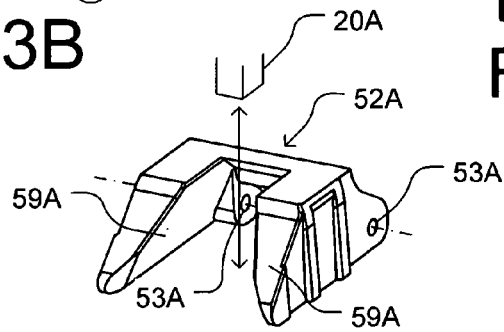
FIG. 3D is a simplified perspective view of a third alternative aligner.

Description—Third Alternative Embodiment—FIG. 3D

FIG. 3D is a simplified perspective view of a third alternative aligner 52A, with the same basic construction as aligner 52 of FIG. 1, shown having two alternative wings 59A without a top connection between them. Aligner 52A has only a rear connection between the wings to allow an alternative projecting member or plunger 20A to pass between the wings from above or within, as shown by the double-headed arrow. Thus, aligner 52A has the same inverted V-shaped configuration as aligner 52 with internally inclined flat and smooth surfaces, and also a horizontal "U" shape if observed from the top (not shown). Two through holes 53A are similar to holes 53 previously described for doing the same.

Operation—Third Alternative Embodiment—FIG. 3D

Alternative aligner 52A is built and works much the same as aligner 52 described previously but allows a top plunger 20A to vertically pass between the wings from above and/or operate between them to engage the top round in the magazine.

CONCLUSION, RAMIFICATIONS, AND SCOPE

The reader will see that we have provided an efficient, simple, and small mechanism and method for aligning magazines of different widths and depths in a magazine loader.

While the above description contains many specificities, these should not be construed as limitation on the scope, but rather as an exemplification of several preferred embodiments.

All numerical values provided are approximate and can be changed.

The aligner may be constructed to fit and operate with most pistol, and some rifle and submachine gun magazine loaders, provided suitable size and shape changes are made in the aligner and/or loader.

A different aligner may be built under the same method described above where a magazine is automatically centered and aligned in a loader, in line with the plunger of the loader. As an example, the aligner may be built using only a single (thick) metal wire formed in the general outer contour and dimensions of aligner 52. Further, any mechanism or element which has an inverted V-shaped open bottom which is smooth and symmetrical on its inner faces may be used. I.e., the wings of the aligner, if any, may have many shapes.

An alternative aligner may be built where its two wings are not connected at all and work and align the magazine independent of each other. For example, the aligner of FIG. 3D having no rear connection (not shown) between its two wings 59A such that each wing can move independent of the other. In such example, each wing will have its own spring or urging means to force the magazine to the center of the loader. Such configuration is also shown in FIG. 3C.

A horizontal V-shaped aligner which accepts a vertically-standing side wall of a magazine, e.g., a rear side wall, instead of its top open end, may also be constructed to accommodate a magazine placed from, e.g., the front of a loader. The magazine will be centered backwards into the loader, as opposed to a magazine placed from below into the loader as described above for the UpLULA loader.

Various other spring types or other mechanical means or methods may replace spring 58.

An industrial machine using the aligner and method described here may be designed for mass loading rounds into magazines. This machine may be used in military armories, shooting ranges, and in production plants.

Accordingly, the scope should be determined, not by the embodiments illustrated, but by the appended claims and their legal equivalents.

The invention claimed is:

1. A mechanism for facilitating the aligning of an open side of a firearm magazine inserted into a magazine loader with respect to a projecting member or plunger of said loader which is arranged to force a topmost round in said magazine further inside said magazine so that a new round can be inserted into said magazine, comprising:

an inverted V-shaped member having two inclined-apart spaced legs or wings coupled together, the upper parts of the wings being closer than their bottom ends when said inverted V-shaped member is seen in its inverted V-shaped configuration, a coupler for attaching said inverted V-shaped member to said magazine loader, a spring member coupled to said inverted V-shaped member and to said loader and arranged to urge said inverted V-shaped member onto said open side of said magazine when said inverted V-shaped member is attached to said loader and a magazine is inserted into said loader, whereby when said inverted V-shaped member is attached to said loader and said loader is placed and forced over said open side of said magazine, said open side of said magazine will be aligned by said inverted V-shaped member with respect to said plunger of said loader so that said plunger will be able to force a topmost round in said magazine further inside said magazine.

2. The mechanism of claim 1 wherein said legs or wings of said inverted V-shaped member have smooth and symmetrical sloping inner faces.

3. The mechanism of claim 1 wherein said legs or wings taper so that their bottoms are narrower than their tops when said inverted V-shaped member is seen in its inverted V-shaped configuration.

4. The mechanism of claim 1 wherein said coupler comprises a hinge for operatively coupling said inverted V-shaped member to said loader.

5. The mechanism of claim 4 wherein said hinge includes a pair of holes in said inverted V-shaped member arranged to align with a pair of mating holes in said loader and a pin extending through said holes in said inverted V-shaped member and through said mating holes in said loader, said pin extending through said spring member.

6. The mechanism of claim 1 wherein said spring member is a torsion spring having a first arm contacting said inverted V-shaped member and a second arm arranged to contact a body of said loader when said inverted V-shaped member is coupled to said loader.

7. The mechanism of claim 1 wherein said legs or wings are coupled together at their top.

8. The mechanism of claim 1 wherein said legs or wings are coupled together at their rear.

9. For a firearm magazine loader arranged to receive a firearm magazine and having a projecting member or plunger which is arranged to force a topmost round in said magazine further inside said magazine so that a new round can be inserted into said magazine, an aligner arranged to center an open top of said magazine with respect to said plunger of said magazine loader, comprising:

an alignment member having a top and an open bottom and a pair of walls that slope inwardly from said bottom to said top so as to provide an inverted V-shape, said walls of said alignment member having smooth and symmetrical inwardly inclined faces adapted to receive and guide said open top of said magazine, said alignment member having means for attaching said member to said loader, said alignment member having means for urging said alignment member onto said magazine when said member is attached to said loader and said magazine is inserted into said loader, whereby when said alignment member is attached to said loader, said alignment member will be able to align said open top of said magazine inserted into said loader with said projecting member or plunger regardless of the size of said magazine within a range of sizes.

10. The aligner of claim 9 wherein said means for urging comprises a spring.

11. The aligner of claim 10 wherein said spring is a torsion spring which has a first arm contacting said alignment member and a second arranged to contact a body of said loader when said alignment member is coupled to said loader.

12. The aligner of claim 9 wherein said means for attaching is a hinge.

13. The aligner of claim 12 wherein said hinge includes a pair of holes in said alignment member arranged to align with a pair of mating holes in said loader and a pin extending through said holes in said alignment member and said mating holes in said loader, said pin extending through said spring member.

14. The aligner of claim 9 wherein said pair of smooth and symmetrical inwardly inclined faces are coupled together at their top.

15. The aligner of claim 9 wherein said pair of smooth and symmetrical inwardly inclined faces are coupled together at their rear.

16. A method of centering or aligning a firearm magazine in a firearm magazine loader for enabling said loader to more reliably facilitate the loading of rounds into said firearm magazine, comprising:

providing a firearm magazine comprising a hollow body with an open top end, said firearm magazine being arranged to hold a stack of rounds therein, providing a firearm magazine loader having a projecting member or plunger at a top thereof and an open end for receiving said magazine, said firearm magazine being insertable into said open end of said firearm magazine loader, providing an aligner within said firearm magazine loader for causing said firearm magazine to be forced to a centered position in said firearm magazine loader when said firearm magazine is inserted through said open end of said firearm magazine loader, said plunger being arranged to press down a top round in said magazine when said magazine is inserted through said open end of said firearm magazine loader and said magazine loader is operated, whereby said aligner will center or align said magazine with said plunger so that said plunger will be directly in line with said top round in said firearm magazine when said firearm magazine is inserted into said open end of said loader, regardless of the size of said magazine within a range of sizes.

17. The method of claim 16 wherein said aligner comprises an inverted V-shaped member having two inclined and spaced legs or wings, the upper inner parts of said legs or wings being closer than their inner bottom ends when said inverted V-shaped member is seen in its inverted V-shaped configuration.

18. The method of claim 17 wherein said aligner further comprises a spring member coupled between said inverted V-shaped member and said firearm magazine loader and arranged to urge said inverted V-shaped member onto said open top end of said firearm magazine.

19. The method of claim 16 wherein said aligner comprises at least a pair of smooth flat leafy spring members or wings that can be attached on opposite sides of an internal body part of said firearm magazine loader so that said wings extends inwardly within said loader for forcing said firearm magazine, when placed in said loader, to align and be centered with respect to said plunger of said firearm magazine loader.

20. The method of claim 16 wherein said aligner is constructed to move linearly up and down without a hinge.

* * * * *